US009675138B2

(12) United States Patent
Mazzarolo et al.

(10) Patent No.: US 9,675,138 B2
(45) Date of Patent: Jun. 13, 2017

(54) SPORTS FOOTWEAR

(71) Applicant: Alpinestars Research SRL, Coste di Maser (Treviso) (IT)

(72) Inventors: Giovanni Mazzarolo, Coste di Maser (IT); Daniele Vanin, Quinto di Treviso (IT)

(73) Assignee: ALPINESTARS RESEARCH SRL, Coste di Maser (Treviso) (IT)

( * ) Notice: Subject to any disclaimer, the term of this patent is extended or adjusted under 35 U.S.C. 154(b) by 30 days.

(21) Appl. No.: 14/431,341

(22) PCT Filed: Sep. 25, 2013

(86) PCT No.: PCT/IB2013/058849

§ 371 (c)(1),
(2) Date: Mar. 26, 2015

(87) PCT Pub. No.: WO2014/049535

PCT Pub. Date: Apr. 3, 2014

(65) Prior Publication Data

US 2015/0237963 A1 Aug. 27, 2015

(30) Foreign Application Priority Data

Sep. 28, 2012 (IT) ..... TV2012A0186

(51) Int. Cl.
*A43C 13/14* (2006.01)
*A43B 5/14* (2006.01)
*A43C 13/08* (2006.01)

(52) U.S. Cl.
CPC ..... *A43C 13/14* (2013.01); *A43B 5/145* (2013.01); *A43C 13/08* (2013.01)

(58) Field of Classification Search
CPC ..... A43C 13/14; A43C 13/08; A43C 13/16; A43C 13/06; A43C 13/147; A43B 5/14; A43B 5/145; A43B 5/00; A43B 5/001
(Continued)

(56) References Cited

U.S. PATENT DOCUMENTS 446,146 A * 2/1891 Hansen ..... A43B 23/086 36/77 R
792,867 A * 6/1905 Wenz ..... A43C 15/161 36/59 R (Continued)

FOREIGN PATENT DOCUMENTS

CN 101742937 A 6/2010
CN 102573548 B 6/2014

(Continued)

OTHER PUBLICATIONS

PCT International Search Report and Written Opinion dated Mar. 7, 2014 for Intl. App. No. PCT/IB2013/058849, from which the instant application is based, 12 pgs.

*Primary Examiner* — Shaun R Hurley
*Assistant Examiner* — Bao-Thieu L Nguyen
(74) *Attorney, Agent, or Firm* — Fredrikson & Byron, P.A.

(57) ABSTRACT

Sports footwear comprising an upper having a toe portion and a sole fixed to said upper. The sports footwear also comprises a protection element mounted on the side surface of the toe portion. This protection element is fixed permanently to the side surface of the toe portion and is provided with an outer surface provided with first coupling means for coupling a covering component on the protection element. The first coupling means of the protection element define a seat suitable for housing a fastening element for fastening the covering element onto the protection element. The seat has a direction of insertion which is substantially parallel to (Continued)

the side surface of the toe portion of the footwear on which the protection element is mounted. A covering component suitable for use with footwear is also described.

15 Claims, 6 Drawing Sheets

(58) Field of Classification Search
USPC ..... 36/77 R
See application file for complete search history.

(56) References Cited

U.S. PATENT DOCUMENTS 1,383,905 A * 7/1921 Gates ..... A43C 13/14 36/72 R
2,179,942 A * 11/1939 Lyne ..... A43B 5/001 36/127
2,325,741 A * 8/1943 Chertok ..... A43B 5/12 36/1
3,789,523 A * 2/1974 Rubin ..... A43B 5/001 36/107
4,121,359 A * 10/1978 Bertetto ..... A43B 5/04 24/69 SK
4,177,583 A * 12/1979 Chapman ..... A43C 13/14 36/110
4,333,248 A * 6/1982 Samuels ..... A43B 3/18 36/101
4,335,529 A * 6/1982 Badalamenti ..... A43B 5/00 36/114
4,538,480 A * 9/1985 Trindle ..... A43B 5/14 24/697.1
4,712,319 A * 12/1987 Goria ..... A43B 1/0036 359/518
4,735,107 A * 4/1988 Winkie ..... A43B 5/14 36/131
4,811,501 A * 3/1989 Okayasu ..... A43C 13/14 36/77 R
4,866,861 A * 9/1989 Noone ..... A43B 5/001 36/127
4,995,174 A * 2/1991 Hong ..... A43C 13/14 36/72 R
5,501,561 A * 3/1996 Wulff ..... A43B 3/00 254/131
5,551,172 A * 9/1996 Yu ..... A43B 7/10 36/3 A
5,740,620 A * 4/1998 Giese ..... A43B 5/04 36/115
5,979,085 A * 11/1999 Ross ..... A43B 3/0078 36/1
6,065,769 A * 5/2000 Simonetti ..... A43B 5/0411 280/613
6,131,312 A * 10/2000 Hung ..... A43C 13/14 36/11.5
6,226,897 B1 * 5/2001 Sand ..... A43B 5/0401 36/107
6,290,250 B1 * 9/2001 Karol ..... A43B 5/0401 280/14.24
6,594,921 B2 * 7/2003 Laio ..... A43B 3/24 36/105
6,745,643 B2 * 6/2004 Lubanski ..... B62K 15/00 36/131
6,763,614 B2 * 7/2004 Smith ..... A43C 11/00 36/50.1
6,802,524 B2 * 10/2004 Karol ..... A43B 5/0401 280/14.22
6,820,354 B1 * 11/2004 Zanatta ..... A43B 5/145 36/102
6,898,873 B2 * 5/2005 Schenone ..... A43B 3/0078 36/101
7,107,707 B2 * 9/2006 Schenone ..... A43B 3/0078 36/100
7,222,441 B2 * 5/2007 Smith ..... A43B 3/103 36/100
7,377,055 B2 * 5/2008 Bramani ..... A43B 5/145 36/131
7,739,809 B2 * 6/2010 Keating ..... A43B 3/24 36/15
8,020,321 B2 * 9/2011 Matthews ..... A63C 13/003 36/122
8,065,819 B2 * 11/2011 Kaufman ..... A43C 11/008 36/122
8,240,068 B1 * 8/2012 Baker ..... A43B 5/145 36/131
8,453,350 B2 * 6/2013 Yang ..... A43B 5/0427 36/100
8,826,571 B2 * 9/2014 Rutherford ..... A43B 3/00 36/136
9,095,185 B1 * 8/2015 Ortner ..... A43B 23/24
2002/0194750 A1 * 12/2002 Feick ..... A43B 3/122 36/101
2005/0278979 A1 * 12/2005 Bramani ..... A43B 5/145 36/59 R
2006/0143951 A1 * 7/2006 Yang ..... A43B 3/0078 36/100
2008/0052959 A1 * 3/2008 Hu ..... A43B 1/0081 36/42
2008/0060223 A1 3/2008 Keating
2010/0000126 A1 * 1/2010 Ortner ..... A43B 1/0054 36/101

FOREIGN PATENT DOCUMENTS

EP 2236050 A1 10/2010
GB 2389027 A 12/2003

* cited by examiner

SPORTS FOOTWEAR

RELATED APPLICATIONS

This application is a 35 U.S.C. 371 national stage filing from International Application No. PCT/IB2013/058849, filed Sep. 25, 2013, and claims priority to Italian Application No. TV2012A000186, filed Sep. 28, 2012, the teachings of which are incorporated herein by reference.

FIELD OF THE INVENTION

The present invention relates to sports footwear. More particularly, the invention relates, albeit not exclusively, to sports footwear suitable for use in motorcycling activities, said footwear being provided with a protection element which is mounted on the side surface of the toe end. The invention also relates to a covering component intended to be used with the protection element of the sports footwear according to the invention.

BACKGROUND

It is known that the sports footwear used in motorcycling activities is generally provided with protection elements suitable for protecting the user's foot from impacts or friction with external objects. These protection elements are usually arranged on the region of the toe end, heel and leg of the footwear.

Moreover, the sports footwear for motorcyclists is generally provided, on the outer side of the toe end, with a protection element suitable for protecting the toe end of the footwear from any abrasion caused by frictional contact of the footwear against the road surface.

Usually these protection elements consist of two separate components which are joined together. The first component, called a "base", is suitable for being fixed permanently, for example by means of gluing, to the footwear, while the second component, also known as "slider", is removably fixed to the base by means of suitable fixing screws and/or fastening means. The slider has the function of covering the base and is made of rigid abrasion-resistant material.

The provision of temporary fixing means between slider and base allows the user of the footwear to replace the slider once the latter becomes worn following frictional contact against the road surface.

The fixing screws used to join together the two components of the protection element usually have their associated longitudinal axes arranged along a direction substantially perpendicular to the outer surface of the slider.

Usually the outer surface of the slider is provided with suitable seats for receiving the heads of the fixing screws such that the latter do not project from the outer surface of the slider.

These protection elements, although widely established, are however not without defects.

Following wear of the slider, if the latter is not promptly replaced by the user, it may happen that the heads of the fixing screws are located flush with or even project slightly from the seats in which they are inserted. In such a situation, in the event of a fall or particularly violent impact, the fixing screws, since their longitudinal axis is arranged in a direction substantially perpendicular to the outer surface of the slider, may penetrate into the base of the protection element until, in the most extreme cases, they come into contact with the user's foot, bruising or even injuring the user.

Moreover, in the case where a worn slider is not promptly replaced, it may happen that, following frictional contact along the road surface, the heads of the screws are damaged, making it in fact impossible or difficult to remove them or replace the slider with a new one.

It is also known to fix the slider to the base by means of fastening systems other than screws, for example using press-on engaging means.

These engaging means on the one hand do not pose the problems mentioned above, but on the other hand do not ensure a stable connection between base and slider. It may happen, for example, that the slider, following frictional contact along the road surface or an impact, becomes detached from the base. In the case where the user of the footwear does not notice that the slider has become detached, subsequent frictional contact of the toe end of the footwear along the road surface results in wear of the base, with the risk that the slider may no longer be able to be fitted and the need to replace the entire footwear in order to restore the initial safety conditions.

In any case, the loss of the slider does not ensure any longer adequate protection of the user's foot and will not protect the upper or sole of the footwear from wear.

The object of the present invention is therefore to overcome at least partly the drawbacks mentioned above with reference to the prior art.

BRIEF SUMMARY OF EMBODIMENTS OF THE INVENTION

In particular, a task of the present invention is to provide sports footwear provided in the toe zone with a protection element able to ensure optimum protection for the toe end of the user's foot.

Moreover, a task of the present invention is to provide a covering component which is able to be used in combination with the protection element of said footwear.

Furthermore, a task of the present invention is to provide a covering component which can be firmly fastened to the protection element of the footwear.

A further task of the present invention is to provide a covering component which can be easily fitted to the protection element of the footwear and which, once worn, may be easily replaced.

Furthermore, a task of the present invention is to provide sports footwear which has in the toe zone a protection element in which the fastening means designed to fasten the corresponding covering component are protected from impacts and abrasions acting on the outer surface of the sports she.

Furthermore, a task of the present invention is to provide sports footwear provided in the toe zone with a protection element in which the fastening means designed to fasten the corresponding covering component do not constitute a danger for the user's foot in the event of a fall and/or violent impact.

Finally, a task of the present invention is to provide footwear provided in the toe zone with a protection element in which the means for fastening together the protection element and the corresponding covering component are not visible, once the covering component has been fastened on the protection element.

These and other objects and tasks are achieved by sports footwear according to Claim 1 and a covering element according to Claim 8.

BRIEF DESCRIPTIONS OF DRAWINGS

The characteristic features and further advantages of the invention will emerge from the description, provided hereinbelow, of a number of examples of embodiment, provided by way of a non-limiting example, with reference to the accompanying drawings in which.

DETAILED DESCRIPTION OF EMBODIMENTS OF THE INVENTION

With reference to the accompanying figures, the sports footwear according to the invention is indicated in its entirety by 10. The description of the footwear 10 and its single components which will be provided below relates to footwear 10 when used correctly. In particular, "front" will indicate the part of the footwear, or of the single components, which during use is relatively closer to the toe end of the foot, while "rear" will indicate the part of the footwear, or of its single components, which during use is relatively closer to the heel. Similarly, "top" will refer to the part of the footwear, or of its single components, which during use is situated relatively further from the ground, while "bottom" will indicate the part of the footwear, or of its single components, which during use is situated relatively closer to the ground.

Furthermore, "inner surface" of the footwear components will indicate the surface of the footwear components which, during normal use, is directed towards the user's foot, while "outer surface" of the footwear components will indicate the surface of said components situated opposite the inner surface.

Figure 2:
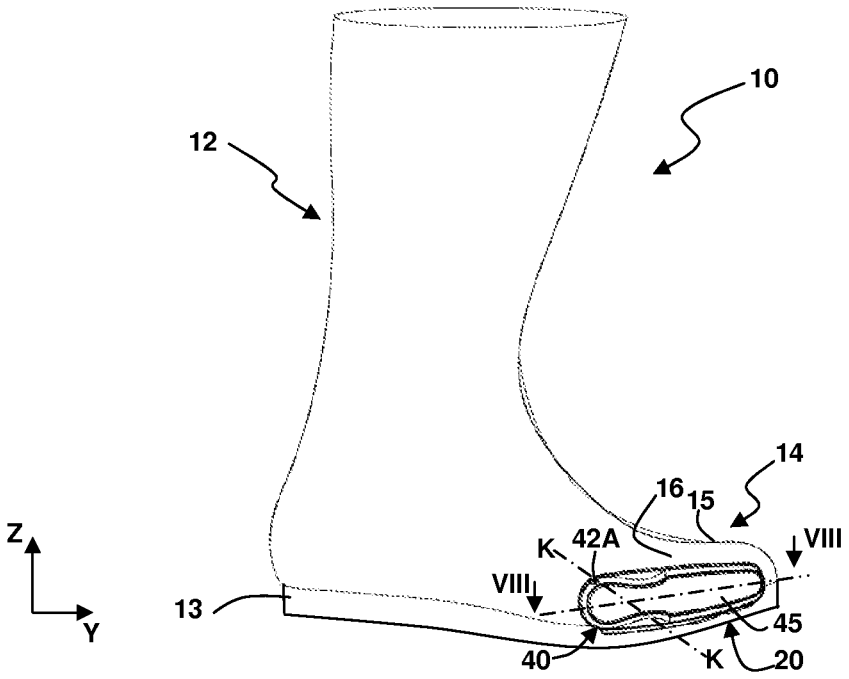
FIG. 2 is a view, similar to that of FIG. 1, in which the protection element of the footwear is provided with a covering component according to the invention.

The footwear 10 according to the invention in a manner known per se comprises an upper 12 to which a sole 13 is fixed. This footwear 10, as is schematically shown in FIGS. 1 and 2, is preferably formed as a boot, being suitable for covering also the bottom part of the leg, as well as the foot and the heel of the user.

In the upper 12 it is possible to identify a toe portion 14, toe portion 14 being understood as meaning the portion of the upper 12 suitable for covering the toe end of the user's foot.

This toe portion 14 has a top surface 15 and two opposite side surfaces. The reference number 16 will be used to indicate the side surface of the toe portion 14 which, during use of the footwear 10, is situated close to the outer side of the user's foot.

Figure 1:
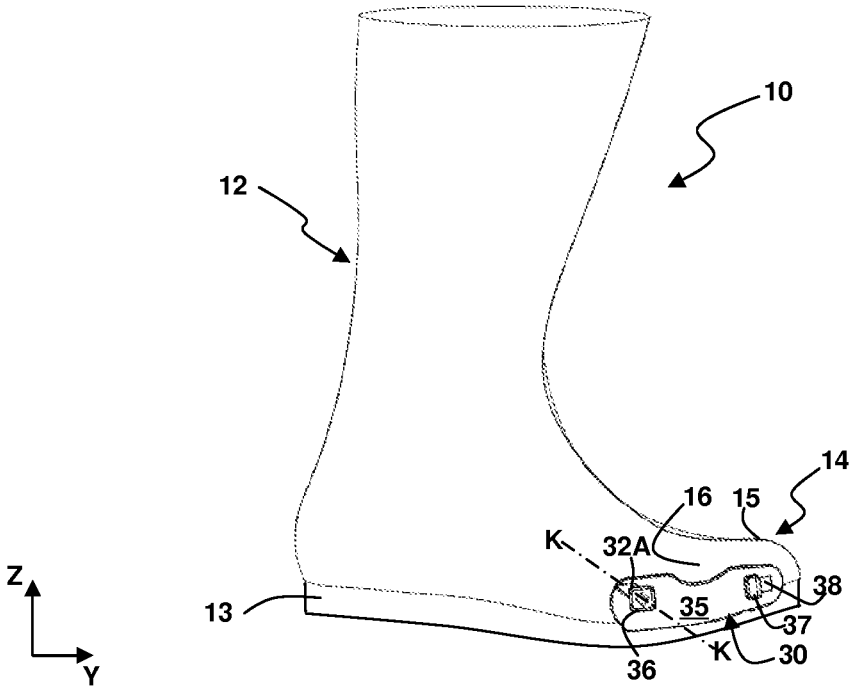
FIG. 1 show a side view of the sports footwear according to the invention.

As shown in FIG. 1, the footwear 10 comprises a protection element 30—called also a "base"—which is mounted on the side surface 16 of the toe portion 14.

The base 30 is fixed permanently to the side surface 16 of the toe portion 14 and has an outer surface 35 on which first coupling means 33, 36 are provided. These first coupling means 33, 36, as will become clear from the description below, are suitable for coupling a covering component 40 on the base 30. This covering component 40 in the description which follows will be called a "slider".

The first coupling means 33, 36 define a seat 32A suitable for receiving a fastening element 50 for allowing the slider 40 to be fastened onto the base 30.

In accordance with the invention, said seat 32A has a direction of insertion K which is substantially parallel to the side surface 16 of the toe portion 14 of the footwear 10 on which the base 30 is mounted.

In order to define more clearly the position of the direction of insertion K a reference system X, Y, X is defined.

The reference plane XY is parallel to the hypothetical support surface of the footwear 10. This reference plane is defined by a reference axis Y, which coincides substantially with an axis tangential to the side surface 16 of the toe portion 14 onto which the base 30 is mounted, and by a reference axis X, which coincides with an axis perpendicular to the axis Y and which is directed towards the outside of the footwear 10.

Generally, the side surface 16 of the footwear 10 is suitably shaped so as to adapt better to the anatomy of the foot and, in this case, different planes tangential to the side surface 16, each with a different inclination, may be defined.

For the purposes of the present invention, the Y axis is identified as being an axis lying in the plane tangential to the portion of the side surface 16 relatively closer to the seat 32A.

The reference axis Z extends perpendicularly with respect to the reference plane XY and is directed from the bottom portion towards the top portion of the footwear 10.

With specific reference to FIGS. 1 and 2, and in accordance with that indicated above, it can be noted how the direction of insertion K may be regarded as lying within the plane ZY and is consequently perpendicular to the axis X. Preferably, as shown in FIGS. 1 and 2, the direction of insertion K has an inclination of about 45° with respect to the reference plane XY. It should be noted however how different inclinations of the direction of insertion K are possible in order to satisfy specific requirements. For example the receiving seat 32A may be provided in the base 30 so as to have a direction of insertion K which is parallel to the plane XY.

As already mentioned, the base 30 is mounted permanently on the upper 12, fixing the inner surface 39 of the base 30 to the side surface 16 of the toe portion 14 in ways known per se, for example by means of gluing.

Preferably, the base 30 is a single-piece component which is obtained by means of a process involving injection-moulding of polymer material. The polymer material is chosen from the group of polymer materials which are usually used for the manufacture of protection elements, for example thermoplastic polyurethanes, commonly called TPU, or polyamides.

Figure 3A:
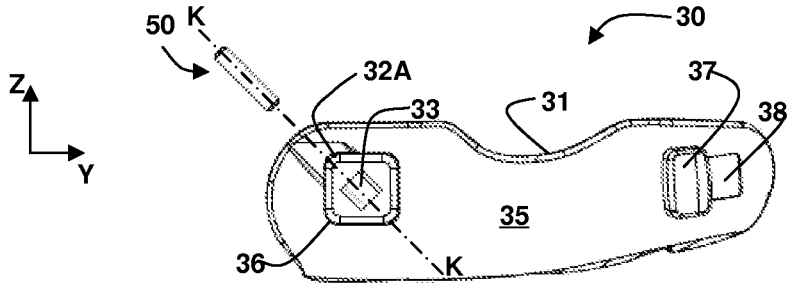
FIGS. 3A and 3B show, respectively, a front schematic view of the protection element according to FIG. 1 and the covering component according to FIG. 2.
Figure 3B:
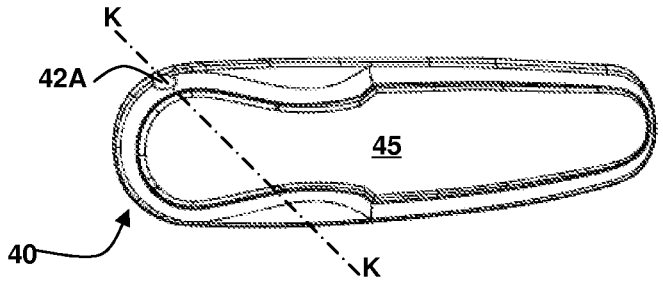
Figure 4A:
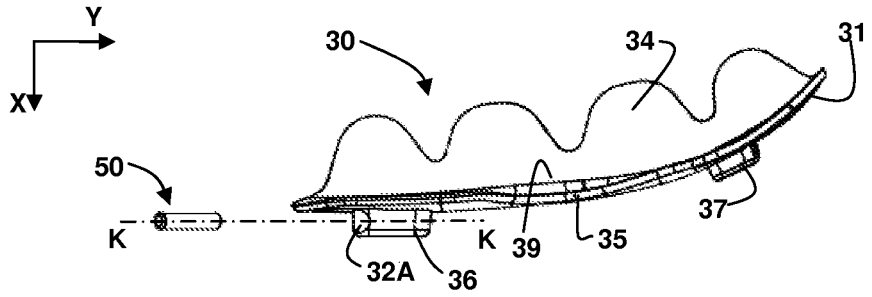
FIGS. 4A and 4B show, respectively, a top schematic view of the protection element according to FIG. 3A and the covering component according to FIG. 3B.
Figure 4B:
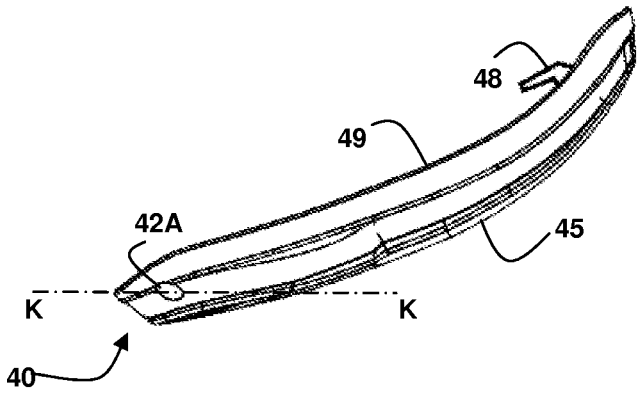

With reference to FIGS. 3A and 4A, the base 30 is preferably shaped according to the profile of the side surface 16 of the toe portion 14 on which it is mounted so as to adapt better to the upper 12 of the footwear 10.

Figure 6:
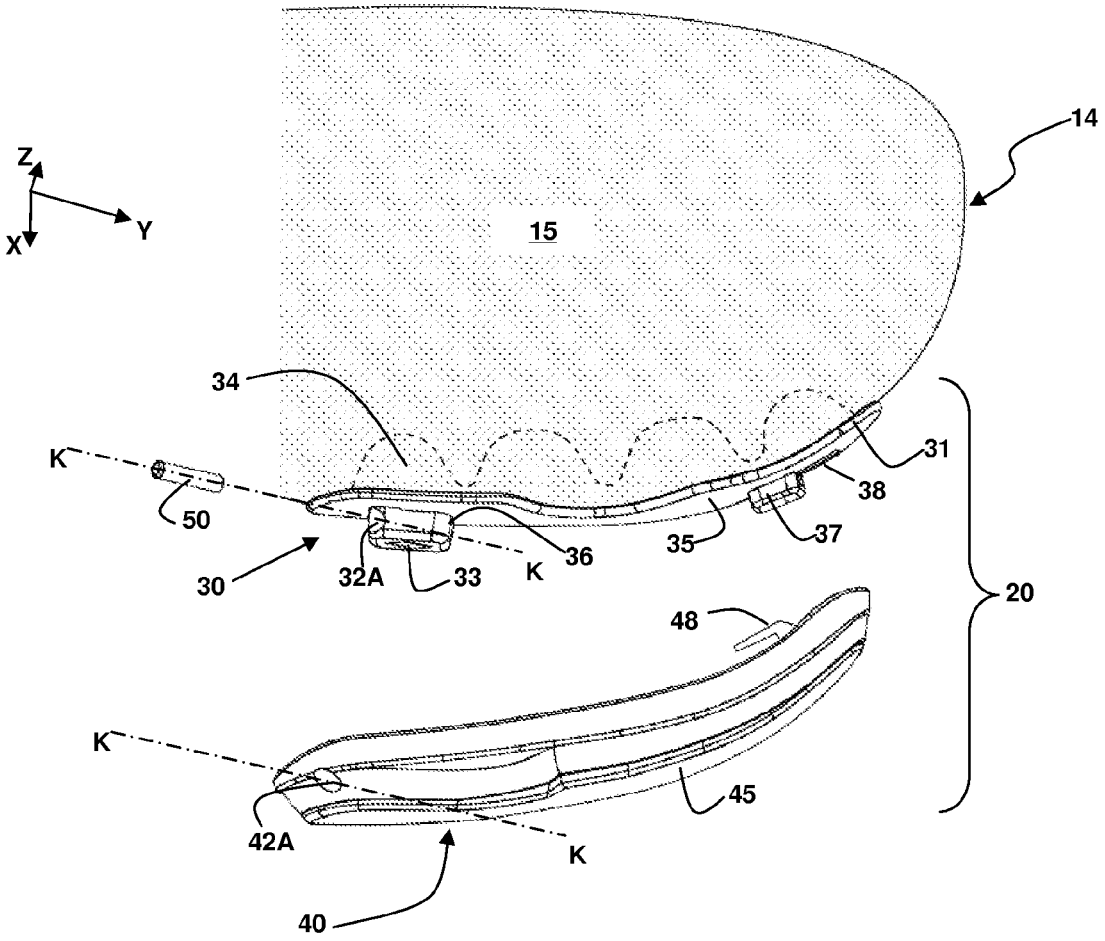
FIGS. 6 and 7 show views similar to that of FIG. 5, but from different perspectives.
Figure 7:
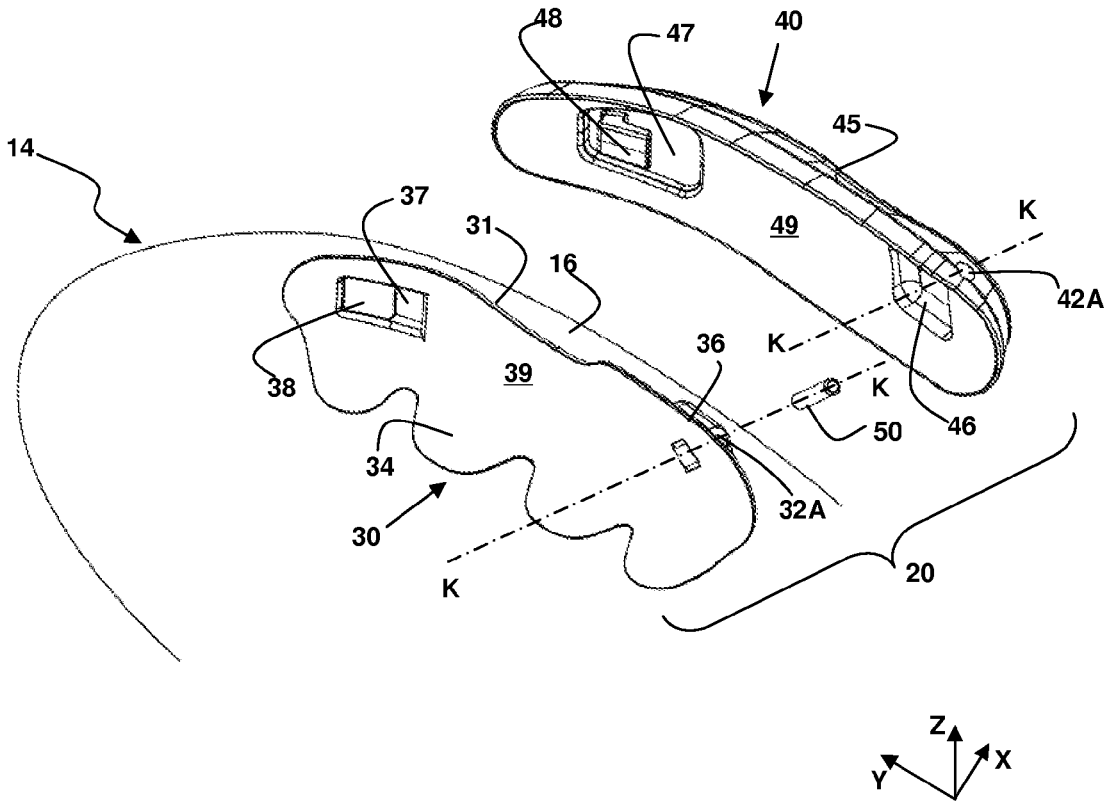

As can be clearly seen in FIGS. 4A, 6 and 7, the base 30, on its bottom portion, has preferably a lug 34. Said lug 34 extends in a direction substantially perpendicular to the inner surface 39 of the base 30. Said lug is suitable for being fixed to the bottom edge of the upper 12 of the footwear 10, being arranged, once the base 30 has been fixed to the footwear 10, between the bottom surface of the upper 12 and the top edge of the sole 13. In this way a better grip between the base 30 and the footwear 10 is ensured. Moreover, the provision of the lug 34 allows not only an increase in the bonding area between the base 30 and the upper 12 of the footwear 10, but also guarantees a better resistance to any stresses acting on the top edge 31 of the base 30. The lug 34, in fact, being gripped between upper 12 and sole 13, ensures a better resistance to any shearing stresses acting on the base 30.

As shown in the accompanying figures, the lug 34 has preferably a small-thickness lobe-like profile so as to ensure a stable connection of the lug 34 to the upper 12 and the sole 13, without reducing the comfort which the footwear 10 is able to provide for the user's foot.

As already mentioned and as shown in FIGS. 3A and 4A, the outer surface 35 of the base 30 is provided with first coupling means 33, 36 for coupling a slider 40 on the base 30.

The first coupling means 33, 36 of the base 30 comprise preferably a first coupling formation 36 which is provided preferably in the rear portion of the base 30.

Said first coupling formation 36 consists of a protuberance of the outer surface 35 of the base 30 and preferably extends in a direction substantially perpendicular to the outer surface 35. This protuberance, in the embodiment shown, has a shape which is comparable to that of the rectangular parallelepiped with a square base, having its base arranged parallel to the outer surface 35.

Advantageously, the protuberance 36 may comprise internally a reinforcing insert 33 which is also suitable for being directly engaged by the fastening element 50. Said insert 33 is preferably a metal insert, for example a metal T-shaped nut, and is designed to be placed inside the mould used to produce the base 30 so that it may be fixed inside the protuberance 36 directly during the process for injection-moulding of the base 30. In this way, in fact, a stable and secure connection between the protuberance 36 and the reinforcing insert 33 is ensured.

Different embodiments of the protuberance 36 and the associated reinforcing insert 33 are however possible in order to satisfy specific fixing requirements.

Advantageously, second coupling means 37, 38 may also be provided on the outer surface of the base 30. Said second coupling means 37, 38 comprise preferably a second coupling formation 37, 38 and are preferably positioned in the portion of the base 30 opposite to that where the first coupling means 33, 36 are positioned. In the embodiments shown in the accompanying figures, the second coupling means 37, 38 are therefore positioned in the front part of the base 30.

The second coupling formation 37, 38 may consist of a pocket 37 and an eyelet 38.

This second coupling formation 37, 38, as will become clear from the description below, has the function of fastening the front portion of the slider 40 onto the base 30. At the same time, the relative arrangement of the pocket 37 and the eyelet 38 is such that said second formation 37, 38 may advantageously act as pivoting point for the slider 40 with respect to the base 30.

In fact, as will be clarified below, said second formation 37, 38 during the operation for fastening and fixing the slider 40 to the base element 30 allows the front part of the slider 40 to be joined to the base 30 and at the same time allows a rotation, albeit small in nature, of the slider 40 about an axis parallel to the reference axis Z and passing through the front end of the pocket 37.

As already mentioned, the present invention relates also to a slider 40 designed to be used in combination with footwear 10 having a base 30 with the technical features described above.

As shown in FIG. 7, the slider 7 has an inner surface 49 provided with first coupling means 46 designed to cooperate with the first coupling means 33, 36 of the base 30.

Said first coupling means 46 define a seat 42A suitable for being engaged by the fastening element 50 used to fasten the slider 40 to the base 30.

In accordance with the invention, said seat 42A has a direction of insertion K which is substantially parallel to the inner surface 49.

As shown in the accompanying figures, the slider 40 may be suitably shaped so as to adapt better to the base 30. For the purposes of the present invention, a direction parallel to the inner surface 49 is defined as being the direction parallel to the portion of the inner surface 49 which is relatively closer to the seat 42A.

In accordance with that shown above and considering that the inner surface 49 of the slider 40 is shaped according to the curvature of the base 30 and that the latter in turn is shaped according to the profile of the side surface 16 of the toe portion 14 of the footwear, it may be noted how, once the slider 40 and the base 30 have been joined together, the direction of insertion K of the seat 42A may be regarded as lying within the reference plane ZY described above.

The slider 40 has the function of covering at least partially the outer surface 35 of the base 30 and may be made entirely of polymer material which is abrasion resistant and/or has a low coefficient of friction, for example polyurethane thermoplastic or polyamide, or may be provided along its outer surface 45 with a suitably shaped metal plate.

As shown in the accompanying figures, the slider 40 has an inner surface 49 suitable for making contact with the outer surface 35 of the base 30.

In the embodiment shown, the first coupling means of the slider 40 comprise preferably a first coupling formation 46 which is provided preferably in the rear portion of the slider 40.

The first coupling formation 46 is designed to cooperate with the first formation 33, 36 of the base 30 in order to define the receiving seat 32A, 42A of the fastening element 50 by means of which the slider 40 is fastened to the base 30.

The first coupling formation 46 consists preferably of a first recess in the inner surface 49. This recess 46 is designed to be coupled with the protuberance 36 of the base element 30, having a corresponding shape and dimensions.

Advantageously, second coupling means 47, 48 may also provided on the opposite portion of the slider 40. Said second coupling means 47, 48 comprise preferably a second coupling formation 47, 48 preferably provided on the front portion of the slider 40.

Said second coupling formation 47, 48 is suitable for cooperating with the second coupling formation 37, 38 of the base 30.

The second coupling formation 47, 48 consists preferably of a second recess 47 on the inner surface 49, inside which a hook element 48 is provided. The second recess 47 and the hook element 48 have advantageously a shape and dimensions suitable for engagement with the pocket 37 and the eyelet 38 of the base 30. In particular, the hook element 48 has a shape and dimensions such as to allow insertion inside the eyelet 38 and subsequent guided sliding inside the pocket 37.

The second recess 47 is in turn designed to receive the pocket 37.

Once fixing has been performed, the hook element 48 is completely inserted inside the pocket 37 so as to prevent the associated portion of the slider 40 from becoming detached from the base 30.

Figure 5:
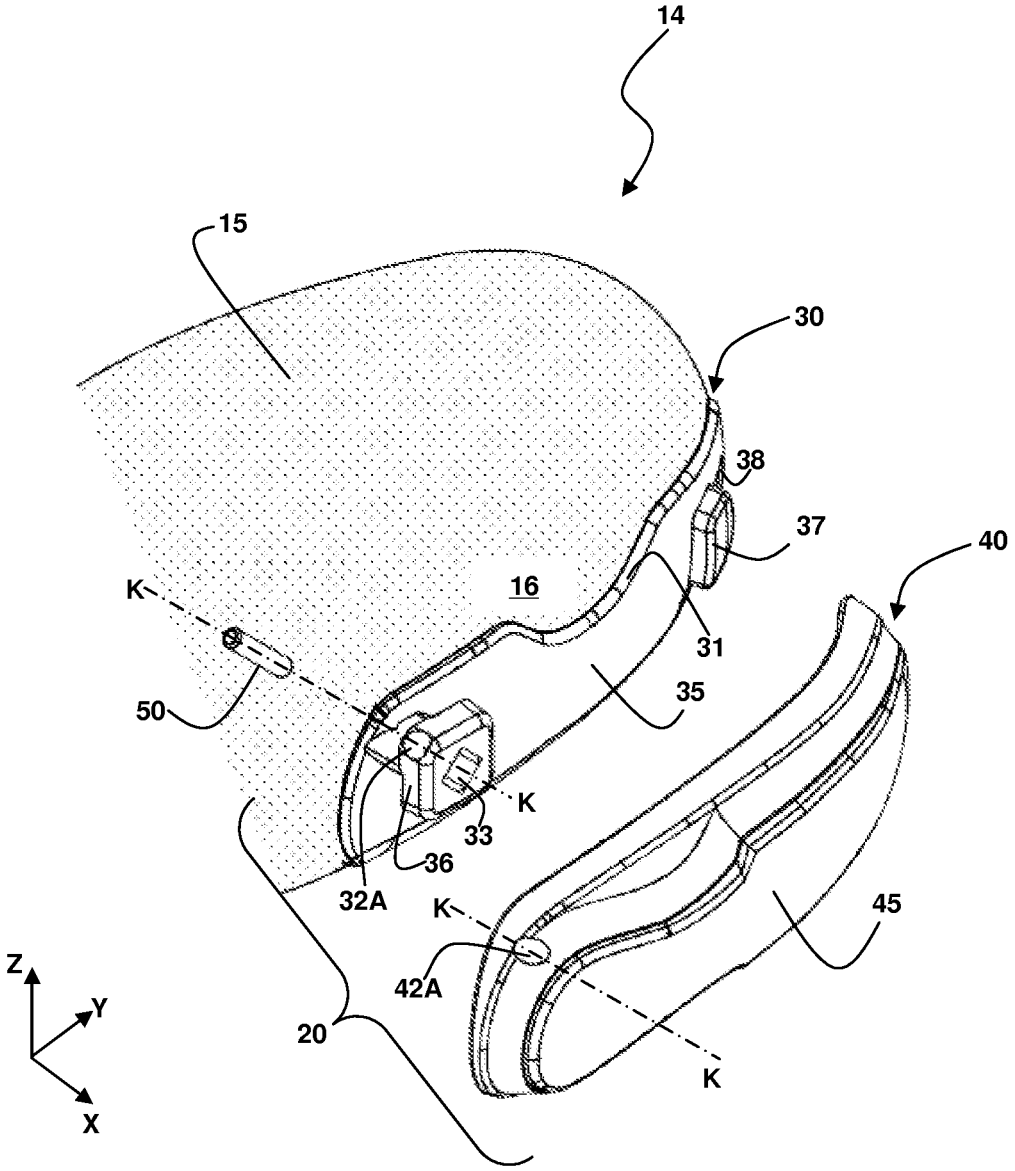
FIG. 5 shows a schematic exploded view of the protection element according to FIGS. 3A and 4A on which the covering component according to FIGS. 3B and 4B has been mounted.

In accordance with the invention, the slider 40 and the base 30 may be releasably fastened together by means of a fastening element 50 so as to form a protection device which, in the accompanying figures (see FIGS. 5-7), is denoted overall by the reference number 20.

The fastening element 50, in order to fasten together base 30 and slider 40, must be inserted simultaneously inside the seat 32A provided in the base 30 and inside the seat 42A provided in the slider 40.

Advantageously, the first seat 32A may be provided in the first coupling formation 33, 36 of the base 30 and the second seat 42A may be provided in the first coupling formation 46 of the slider 40.

In greater detail, the first seat 32A may be formed in the first projection 36 and in the associated reinforcing insert 33 of the base 30 and the second seat 42A may be formed in the vicinity of the recess 46 of the slider 40. As can be clearly seen in FIG. 7, the second seat 42A is designed to establish fluid communication between the outer surface 45 of the slider 40 and the recess 46 provided in the inner surface 49 thereof.

The first seat 32A and the second seat 42A, once the projection 36 of the base 30 is inserted in the recess 46 of the slider 40, are preferably contiguous and have their respective longitudinal axes which are aligned with each other. In this configuration of use, said longitudinal axes coincide with the direction of insertion K of the fastening element 50. In this way, the fastening element 50 may, by sliding inside the second seat 42A and the first seat 32A, engage in succession the slider 40 and the base 30, locking together said elements and forming the device 20.

The fastening element 50 is preferably a screw comprising a head and a threaded shank.

Advantageously, the provision of the metal reinforcing insert 33 in the projection 36 allows the gripping force of the fastening element 50 on the base 30 to be increased, ensuring a stable and reliable connection between the base 30 and the slider 40.

In the embodiment shown in the accompanying figures the fastening element 50 is a screw suitable for engaging with a thread of corresponding pitch provided on the inner surfaces of the seat 32A and, where necessary, the seat 42A. If present, the metal reinforcing insert 33 allows a very strong thread to be provided for the fastening element 50. Preferably the threaded screw 50 will have a length the same as, or slightly smaller than, that of the receiving seat obtained by aligning the first seat 32A and the second seat 42A. In this way it is ensured that, once fastening of the slider 40 on the base 30 has been completed, the screw 50 does not project from the outer surface of the slider 40.

Different embodiments of the fastening element 50 which may be easily imagined by the person skilled in the art are in any case possible in order to satisfy specific needs.

Figure 8:
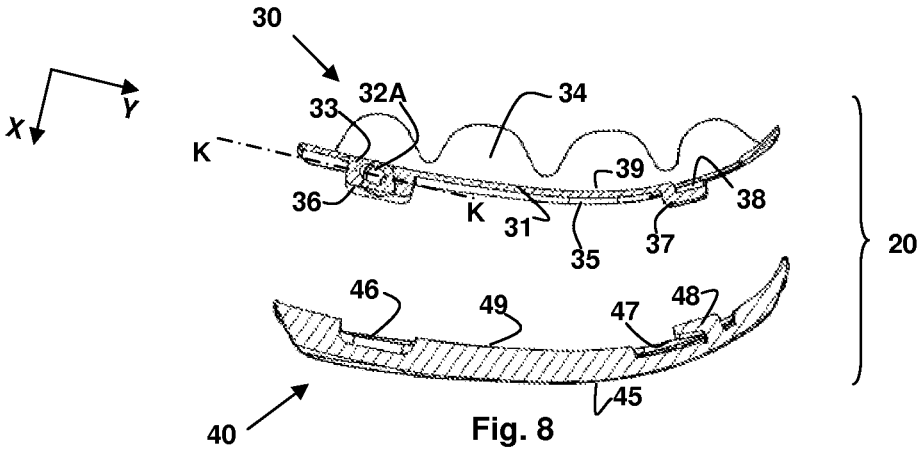
FIGS. 8, 8A and 8B show schematically a cross-sectional view of the protection element and the associated covering component along the plane indicated by VIII-VIII in FIG. 2, in different operating configurations.
Figure 8A:
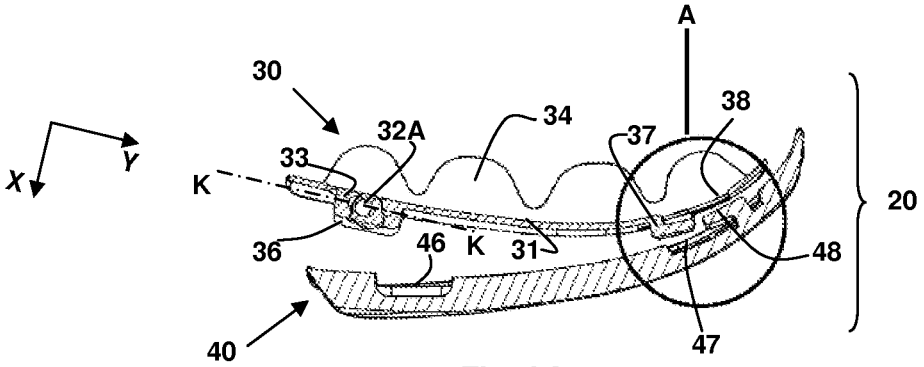
Figure 8B:
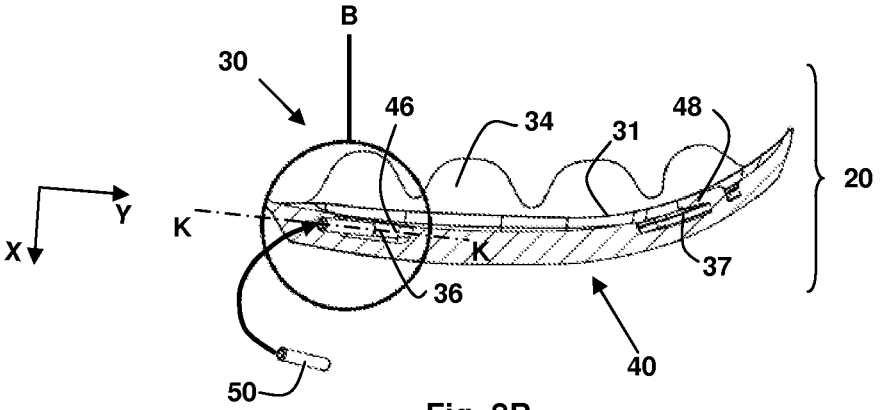

With reference to FIGS. 8, 8A and 8B and in accordance with the innovative principles of the invention, below the ways in which the user of the footwear 10 may releasably fasten the slider 40 on the base 30, assuming that the base 30 and the slider 40 are both provided with first and second coupling formations, are described.

Initially, the slider 40 is moved towards the base 30, keeping the inner surface 49 of the slider 40 directed towards the outer surface 35 of the base 30 (see FIG. 8). Thereafter the slider 40 is inclined slightly, causing it to perform a small rotation about the reference axis Z so that the hook element 48 may enter edgewise inside the eyelet 38 and the pocket 37 may in turn be housed inside the second recess 47 of the slider 40 (see FIG. 8A).

The hook element 48 is then displaced in the direction of the pocket 37 so as to be able to be inserted inside it. In this way the front surface of the slider 40 is joined to the front surface of the base 30 (see FIG. 8A).

Owing to the rotary-translatory movement performed by the slider 40 it is possible to align the protuberance 36 with the recess 46 and then insert the projection 36 inside the recess 46. After insertion of the protuberance 36 inside the recess 46, the covering element 40 is joined to the base 30 also in its rear portion.

Moreover, the insertion of the protuberance 36 inside the recess 46 allows alignment of the first receiving seat 32A and the second receiving seat 42A for the fastening element 50.

In order to complete fastening of the slider 40 to the base 30 the user must, finally, insert the fastening element 50 inside the first receiving seat 32A and the second receiving seat 42A.

Insertion of the fastening element 50 inside the seats 32A and 42A enables the slider 40 to be locked on the base 30, preventing the slider 40 from being able to be detached from the base 30 following an impact or a stressing force.

In the case where the user must replace a worn slider 40 it will be sufficient, in order to separate the slider 40 from the base 30, to remove the fastening element 50 from the associated seats 32A, 42A and perform the same actions described above in the reverse order.

At this point it is clear how the predefined objects may be achieved with the sports footwear 10 and the slider 40 according to the invention.

The receiving seats 32A and 42A for the fastening element 50, since they have a direction of insertion K arranged in one of the directions described above, on the one hand are easily accessible by the user and on the other hand are protected against any impacts or frictional contact.

Moreover, this arrangement does not adversely affect fastening between the base 30 and the slider 40 of the protection device 20. The provision of a form-fit between the projection 36 of the base 30 and the recess 46 of slider 40 prevents in fact the slider 40 from being able to rotate relative to the base 30 about an axis parallel to the reference axis X, while insertion of the fastening element 50 allows locking together of base 30 and slider 40.

It should also be noted that the fastening element 50, once the slider 40 is fixed to the base 30, is arranged in a direction substantially parallel to the user's foot and therefore in the event of an impact or a stressing force acting on the slider 40, the possibility of one end of said fastening element 50 being able to penetrate into the base until it reaches and strikes the user's foot is prevented, which possibility instead exists in the case of the known protection devices.

To conclude, the sports footwear 10 and the slider 40 described in the present invention offer a greater level of safety and comfort than the footwear described with reference to the prior art.

With regard to the embodiments of the footwear 10 and slider 40 described above, the person skilled in the art may, in order to satisfy specific requirements, make modifications to and/or replace elements described with equivalent elements, without thereby departing from the scope of the accompanying claims.

For example, the first coupling formation 36 of the base 30 and the first coupling formation 46 of the slider 40 may be provided in the front portion of the base 30 and the slider 40.

Moreover, the second coupling formation 37, 38 of the base 30 and the second coupling formation 47, 48 of the slider 40 may comprise snap-engaging means.

The invention claimed is:

1. Sports footwear comprising:

an upper with a toe portion;

a sole fixed to said upper;

a protection element mounted on a side surface of said toe portion;

said protection element being fixed permanently to the side surface and having an outer surface provided with first coupling means for coupling a covering component on the protection element;

the first coupling means of the protection element in part defining a seat suitable for receiving a fastening element for allowing fastening of the covering component onto the protection element;

said footwear being characterized in that said seat has a direction of insertion which is substantially parallel to the side surface of the toe portion.

2. The sports footwear according to claim 1, wherein said first coupling means of the protection element comprise a first coupling formation provided in a rear portion of the protection element.

3. The sports footwear according to claim 2, wherein said first coupling formation consists of a protuberance of the outer surface of the protection element, said protuberance extending in a direction substantially perpendicular to the outer surface.

4. The sports footwear according to claim 1, wherein said first coupling means of the protection element comprise a reinforcing insert suitable for being engaged by the fastening element.

5. The sports footwear according to claim 1, wherein the outer surface of the protection element is provided with second coupling means for coupling the covering component on the protection element;

said second coupling means of the protection element comprising a second coupling formation positioned on a portion of the protection element opposite of where the first coupling means of the protection element are positioned.

6. The sports footwear according to claim 5, wherein said second coupling formation comprises a pocket and an eyelet;

said pocket and said eyelet being positioned in a front portion of the protection element and being suitable for fastening a front portion of the covering component onto a front portion of the protection element.

7. The sports footwear according to claim 1, wherein the protection element, on a bottom portion, is provided with a lug which extends in a direction substantially perpendicular to an inner surface of the protection element;

said lug being suitable for being fixed to a bottom edge of the upper.

8. Covering component suitable for use with sports footwear, said sports footwear comprising:

an upper with a toe portion;

a sole fixed to said upper;

a protection element mounted on a side surface of said toe portion;

said protection element being fixed permanently to the side surface and having an outer surface provided with first coupling means for coupling the covering component on the protection element;

said covering component having an inner surface provided with first coupling means suitable for cooperating with the first coupling means of the protection element;

the first coupling means of the covering component in part defining a seat suitable for being engaged by a fastening element so as to fasten said covering component on the protection element;

the covering component being characterized in that the seat has a direction of insertion substantially parallel to the inner surface.

9. The covering component according to claim 8, wherein said first coupling means of the covering component comprise a first coupling formation provided in a rear portion of the covering component.

10. The covering component according to claim 9, wherein said first coupling formation comprises a recess in the inner surface of the covering component;

said recess being suitable for being coupled with a protuberance of the protection element.

11. The covering component according to claim 8, wherein the inner surface is provided with second coupling means on a portion of the covering component opposite of where the first coupling means are positioned;

said second coupling means of the covering component comprising a second coupling formation suitable for cooperating with a second coupling formation of the protection element so as to fasten the covering component together with the protection element.

12. The covering component according to claim 8, wherein said seat has a longitudinal axis suitable for being aligned with a longitudinal axis of a seat of the protection element when the first coupling formation of the protection element is inserted inside the first coupling formation of the covering component;

said seats when so configured being adjacent and having respective longitudinal axes coinciding with the direction of insertion.

13. The covering component according to claim 9, wherein said seat of the covering component is suitable for establishing fluid communication between the outer surface of the covering component and the first coupling formation of the covering component.

14. The covering component according to claim 11, wherein the second coupling formation of the covering component comprises a recess and a hook element;

said second coupling formation being suitable for acting as a pivoting point for the covering component on the protection element.

15. The sports footwear according to claim 1, further comprising the covering component which has an inner surface provided with first coupling means suitable for cooperating with the first coupling means of the protection element, wherein the first coupling means of the covering component in part defines a seat suitable for being engaged by a fastening element so as to fasten said covering component on the protection element, and wherein the seat has a direction of insertion substantially parallel to the inner surface.

* * * * *